United States Patent [19]

Janssen et al.

[11] 4,267,412

[45] May 12, 1981

[54] ELECTRICAL SWITCH

[75] Inventors: Johannes T. M. Janssen, Hedel; Hermanus P. J. Gilissen, Esch; Lucas Soes, Rosmalen; Ludovicus C. Van Der Sanden; Petrus R. M. Van Dijk, both of 's-Hertogenbosch, all of Netherlands

[73] Assignee: AMP Incorporated, Harrisburg, Pa.

[21] Appl. No.: 51,089

[22] Filed: Jun. 22, 1979

[51] Int. Cl.[3] ..... H01H 19/60

[52] U.S. Cl. ..... 200/6 B; 200/6 BB; 200/11 G; 200/291; 200/303

[58] Field of Search ..... 200/6 R, 6 B, 6 BA, 200/6 BB, 6 C, 11 R, 11 D, 11 DA, 11 E, 11 EA, 11 G, 11 K, 11 TW, 16 R, 16 D, 153 L, 155 R, 155 A, 164 A, 291, 303, 336

[56] References Cited

U.S. PATENT DOCUMENTS

| | | | |
|---|---|---|---|
| 1,998,995 | 4/1935 | Petersen | 200/155 A |
| 2,100,426 | 11/1937 | Berger et al. | 200/155 A |
| 2,386,047 | 10/1945 | Gates | 200/6 BB |
| 2,834,842 | 5/1958 | Le Beau | 200/11 K |
| 3,300,594 | 1/1967 | Paine et al. | 200/11 G |
| 3,371,167 | 2/1968 | Soulakis, Jr. | 200/11 G |
| 4,133,990 | 1/1979 | Wanner et al. | 200/6 B |
| 4,150,263 | 4/1979 | Neveux | 200/291 X |

FOREIGN PATENT DOCUMENTS

| | | | |
|---|---|---|---|
| 495432 | 6/1954 | Italy | 200/155 A |
| 1111721 | 5/1968 | United Kingdom | 200/153 L |

*Primary Examiner*—James R. Scott

*Attorney, Agent, or Firm*—David C. Ripma; Jay L. Seitchik

[57] ABSTRACT

An electrical switch comprises a base (1) of electrically insulating material carrying an input contact (2) and a plurality of output contacts (3); a bridging contact (5) fixedly mounted on the base (1) in permanent connection with the input contact (2), and having a plurality of resilient contact arms (6) respectively associated with the output contacts (3), and an operating member mounted on the base and formed with a plurality of cam projections (11) adapted and arranged to engage the contact arms (6) of the bridging contact (5) as the operating member (8) is moved relative to the base (1), thereby to urge the contact arms (6) into contact with the associated output contacts (3).

6 Claims, 5 Drawing Figures

FIG.1.
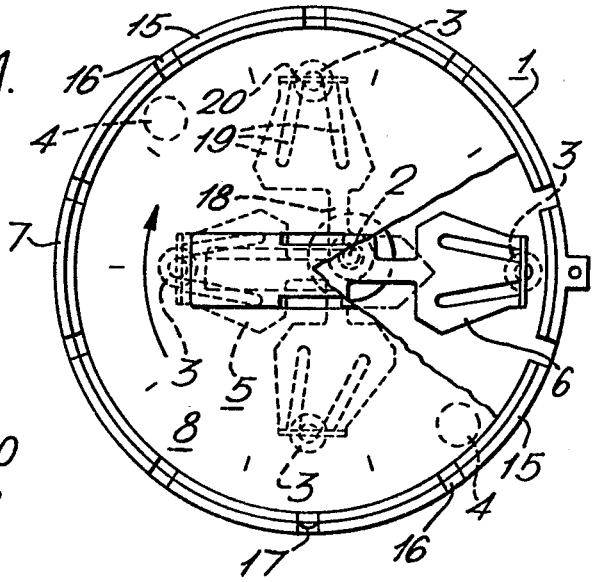
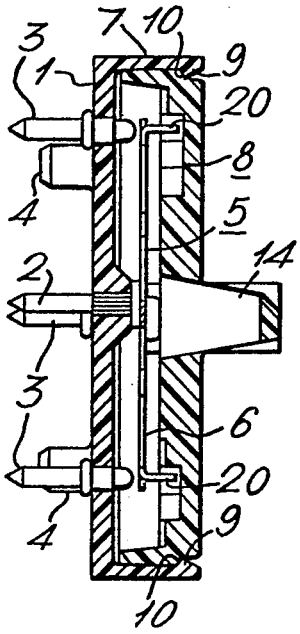
FIG.2.
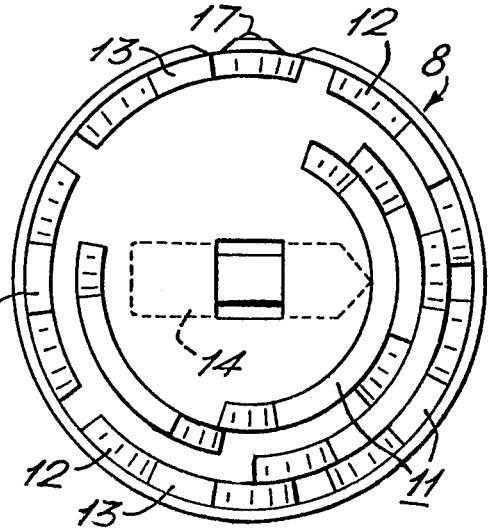
FIG.3.

FIG.4.
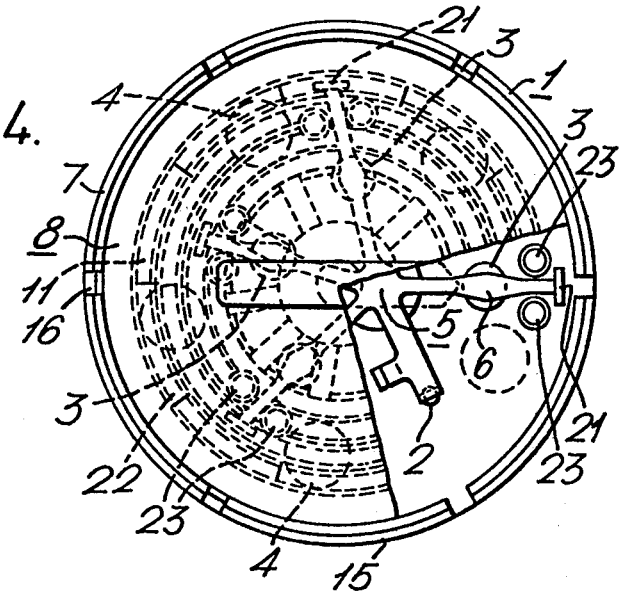
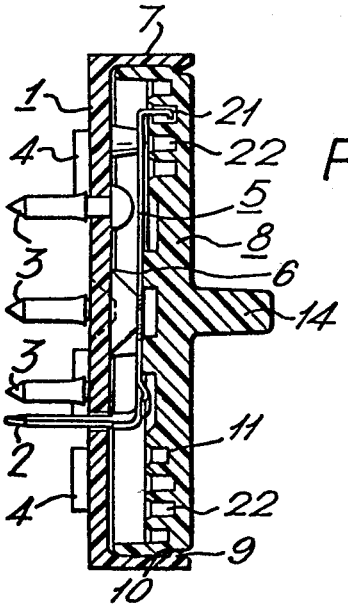
FIG.5.

ELECTRICAL SWITCH

BACKGROUND OF THE INVENTION

This invention relates to an electrical switch, and particularly to an electrical switch capable of selectively providing a connection between an input contact and any one or more of a plurality of output contacts.

Such switches can be arranged to give a binary or other coded output, and find use, for example, as programming devices in electronic equipment.

Known such switches comprise a base of electrically insulating material carrying an input contact and a plurality of output contacts; a bridging contact capable of providing connections between the input contact and any one or more of the output contacts; and an operating member mounted on the base and movable relative thereto between a plurality of relative positions in each of which the bridging contact is caused to provide a connection between the input contact and a respective one or combination of the output contacts.

Such known switches are generally of complicated structure and are thus expensive and difficult to assemble.

According to this invention such a switch is characterised in that the bridging contact is fixedly mounted on the base in permanent connection with the input contact and has a plurality of resilient contact arms respectively associated with the output contacts, the operating member being formed with a plurality of cam projections adapted and arranged to engage the contact arms of the bridging contact as the operating member is moved relative to the base, thereby to urge the contact arms into contact with the associated output contacts.

BRIEF DESCRIPTION OF THE DRAWINGS

This invention will now be described by way of example with reference to the drawings, in which:

FIG. 1 is a top plan view with part broken away of a first electrical switch according to this invention;

FIG. 2 is a vertical sectional view of the switch of FIG 1;

FIG. 3 is an underneath plan view of the operating member of the switch of FIGS. 1 and 2;

FIG. 4 is a top plan view with part broken away of a second electrical switch according to this invention; and FIG. 5 is a vertical sectional view of the switch of FIG. 4.

BRIEF DESCRIPTION OF THE PREFERRED EMBODIMENTS

The switch shown in FIGS. 1 to 3 comprises a circular base 1 moulded from electrically insulating plastics material, and carrying an input contact 2 and four output contacts 3. The contacts 2 and 3 are in-moulded in the base 1, and each has an outwardly projecting pin portion for receipt in a hole in a substrate (not shown) thereby to connect the contact 2 or 3 to a conductor on the substrate which may be a printed circuit board. The outer face of the base 1 from which the pin portions of the contacts 2 and 3 project is formed with two diametrically opposed circular bosses 4 which in use of the switch are received in holes in the substrate to locate the switch on the substrate. The inner ends of the output contacts 3 project above the adjacent surface of the base 1 to constitute contact points while the inner end of the input contact 2 has a flat head on which is welded a substantially planar bridging contact 5 having four contact arms 6 associated with the four output contacts 3 respectively.

As clearly shown in FIG. 1, the output contacts 3 are located at positions spaced at about 90° around the centre of the base 1 and at mutually different distances, that is radii, from the centre of the base 1, and the input contact 2 is offset from the centre of the base 1 such that it is substantially equi-spaced from each of the output contacts 3. Thus, the effective lengths of the four contact arms 6 of the bridging contact 5 are also equal.

The base 1 is formed with an upstanding peripheral flange 7 within which is received a circular operating member 8 which completes the switch. The flange 7 has an inwardly directed lip 9 which engages over an annular shoulder 10 on the operating member 8 to mount the operating member 8 on the base 1.

The inner surface of the operating member 8 is formed with a plurality of arcuate cam projections 11 having mutually different radii measured from the centre of the operating member 8, that is from the axis of rotation thereof, which axis passes through the centre of the base 1.

There is at least one cam projection 11 having a radius of curvature equal to the distance of each of the output contacts 3 from the centre of the base 1. Each cam projection has end surfaces 12 which slope from the surface of the operating member 8 up to a level middle surface 13 which is parallel to the surface of the operating member 8.

The operating member 8 is formed with an outwardly directed bar 14 which can be gripped by a user's fingers to rotate the operating member 8 relative to the base 1. The flange 7 on the base 1 is divided into a plurality of circumferentially spaced segments 15 by ten slots 16, and the operating member is formed with a projection 17 on its peripheral edge, which projection 17 is engageable in the slots 16 to provide an indexing action on rotation of the operating member relative to the base 1, the slots 16 and projection 17 thus together defining ten rotary positions of the operating member 8 relative to the base 1.

As clearly shown in FIG. 1, each contact arm 6 of the bridging contact 5 comprises a single limb 18 extending from the input contact 2 and carrying at its outer end a three-legged arrangement comprising three outwardly extending substantially equal length legs 19 lying in a common plane. The free end of the centre leg 19 constitutes a contact portion for engagement with the associated output contact 3 positioned beneath the centre leg 19, and the two outer legs 19 are joined by an arcuate linking member 20 which extends towards the operating member 8 for engagement by the cam projection or projections 11 associated therewith.

The arrangement is such that when the linking member 20 of a contact arm 6 is not engaged with an associated cam projection 11 on the operating member 8, the centre leg 19 of that contact arm 6 is out of engagement with the associated output contact 3, as shown in FIG. 2. When the operating member 8 is rotated relative to the base 1 to a position in which the linking member 20 is engaged by an associated projection 11, then the centre leg 19 is held in engagement with the associated output contact 3 whereby the bridging contact 5 provides a connection between the input contact 2 and that output contact 3.

As can be ascertained from FIG. 3, the cam projections 11 are arranged such that for each of the ten rotational positions of the operating member 8 relative to the base 1 a unique combination of connections between the input contact 2 and the output contacts 3 is established by the bridging contact 5, these connections enabling a binary coded decimal output to be obtained from the output contacts 3 from a voltage applied to the input contact 2.

The three-legged form of each of the contact arms 6 of the bridging contact 5 is advantageous in that it gives a two stage closing of the centre leg 19 onto the associated output contact 3, this ensuring ease of operation of the switch with a final high contact force between the centre leg 19 and the output contact 3. When the sloping surface 12 of a cam projection 11 first engages the linking member 20 of a contact arm 6, the whole contact arm 6 including the limb 18 is deflected about the connection of the contact arm 6 to the input contact 2 until the centre leg 19 of the contact arm 6 engages the associated output contact 3. Thereafter only the two outer legs 19 are deflected relative to the centre leg 19 thereby increasing the contact force between the centre leg 19 and the output contact 3 until the linking member 20 is engaged with the planar surface 13 of the cam projection 11. Further, since all three legs 19 are of substantially equal length whereby the linking member 20 engages the cam projection 11 over the associated output contact 3 a maximum contact force is obtained for a minimum applied force, and thus the switch is easy to operate.

Referring now to FIGS. 4 and 5, the switch here shown is somewhat similar to that shown in FIGS. 1 to 3, and corresponding parts have the same reference numerals. The essential difference is in the form of the bridging contact 5.

In this switch the input contact 2 is constituted by an arm of the bridging contact 5, which is bent to extend through the base 1. Each contact arm 6 of the bridging contact 5 is a single limb the free end 21 of which is bent to extend away from the base 1 to be received in a respective annular groove 22 in the operating member 8. The cam projections 11 engaged by the free ends 21 of the contact arms 6 are formed by changes in the depths of the grooves 22, such that as the operating member 8 is rotated relative to the base 1 the contact arms 6 are deflected towards the base 1 such that a point on the contact arm 6 intermediate the ends thereof is urged into contact with the associated output contact 3. Each contact arm 6 is received between a respective pair of bosses 23 upstanding from the base 1 adjacent the free end of the contact arm 6, which bosses 23 serve to restrain the contact arm 6 from rotary movement with the operating member 8 relative to the base 1. As shown in FIG. 4, the flange 7 of the base 1 is provided with six slots 16 defining rotational positions of the operating member 8 relative to the base 1, the cam projections 11 being such that for each of these positions a particular combination of connections between the input contact 2 and the output contacts 3 is established by the bridging contact 5. Further, the base 1 is formed with five locating bosses 4 on its outer surface.

A particular advantage of the switches described above are that simply by changing the operating member to one with a different arrangement of cam projections, the coding of the switch can be changed. Further, since there is substantially no sliding contact between the output contacts and the contact arms of the bridging contact, it is possible to have high contact forces with only little wear of the contact surfaces. The only slight sliding contact which takes place is however sufficient to provide cleaning of the contact surfaces. It is thus possible to use tin-plated members for the contacts rather than the often used more expensive gold-plated contacts.

What is claimed is:

1. An electrical switch comprising a circular base formed of electrically insulating material, an operating member of circular shape mounted for rotation on said base about an axis of rotation passing through the centers of said base and said operating member, said base and operating member including engaging portions along their respective peripheries which cooperate to mount said operating member for rotation on said base, said engaging portions including indexing means for indexing the motion of said operating member to one of a plurality of positions relative to said base, an input contact and a plurality of output contacts mounted on said base at positions spaced around the center of said base at mutually different distances from the center of said base, and a bridging contact fixedly mounted on the input contact having a plurality of radially extending resilient contact arms respectively associated with the output contacts, said operating member being formed with a plurality of arcuate cam projections thereon positioned at mutually different radii measured from the axis of rotation of the operating member such that the arcuate cam projections engage the contact arms of the bridging contact as said operating member is rotated relative to said base, there being at least one said arcuate cam projection associated with each output contact to urge the contact arms into contact with the associated output contacts whereby in each of the relative positions of the operating member the bridging contact is caused to provide a connection between the input contact and a respective one or combination of the output contacts.

2. A switch as in claim 1 in which said input contact is offset from the axis of rotation of said operating member and the contact arms of the bridging contact are all of substantially equal effective length.

3. A switch as in claim 1 in which said engaging portions between said base and said operating member include an upstanding peripheral flange formed on said base having an inward directed lip which engages over an annular shoulder formed on said operating member to mount said operating member for rotation on said base.

4. A switch as in claim 3 in which said flange on said base is divided into a plurality of circumferentially spaced segments separated by slots, said operating member being formed with a projection on its peripheral edge, which projection is engageable in the slots between adjacent segments of the flange on said base to provide an indexing action on rotation of said operating member relative to said base.

5. A switch as in claim 1 in which the free end of each contact arm of the bridging contact is bent to extend away from said base and is received in a respective annular groove in said operating member, each contact arm additionally being received between a respective pair of bosses upstanding from said base adjacent the free end of the contact arm, the cam projections being formed as changes in the depth of the grooves in said operating member, and the point of contact between each contact arm and the associated output contact being intermediate the ends of the contact arm.

6. A switch as in claim 1, in which each contact arm of the bridging contact comprises a single limb extending from the input contact and carrying at its outer end a three-legged arrangement comprising three outwardly extending substantially equal length legs lying in a common plane, the free end of the center leg constituting a contact portion for engagement with the associated output contact, and the two outer legs being joined by a linking member which extends towards the operating member for engagement by the cam projection or projections associated therewith.

* * * * *